US005187681A

United States Patent [19]

Mitsutsuka

[11] Patent Number: 5,187,681

[45] Date of Patent: Feb. 16, 1993

[54] CONTROLLING APPARATUS FOR IMPROVING START UP TIME FOR A CONVOLVER

[75] Inventor: Syuichi Mitsutsuka, Tokyo, Japan

[73] Assignee: Clarion Co., Ltd., Tokyo, Japan

[21] Appl. No.: 623,294

[22] Filed: Dec. 6, 1990

[30] Foreign Application Priority Data

Dec. 6, 1989 [JP] Japan ..... 1-316646

[51] Int. Cl.[5] ..... G06G 7/12

[52] U.S. Cl. ..... 364/821; 310/313 R

[58] Field of Search ..... 364/821; 310/313 A, 310/313 B, 313 D, 313 R; 333/150-155, 193-196

[56] References Cited

U.S. PATENT DOCUMENTS 2,745,378 5/1988 Niitsuma et al. ..... 310/313 B
4,024,480 5/1977 Reeder et al. ..... 364/821
4,489,289 12/1984 Slobodnik et al. ..... 310/313 A
4,697,115 9/1987 Mitsutsuka ..... 310/313 D
4,798,988 1/1989 Mitsutsuka ..... 310/313 R
5,070,472 12/1991 Okagaki ..... 364/821

*Primary Examiner*—Jerry Smith
*Assistant Examiner*—Jim Trammell
*Attorney, Agent, or Firm*—Fish & Richardson

[57] ABSTRACT

A control apparatus for a surface acoustic wave convolver element having a gate electrode, a grounded electrode and a piezoelectric layer therebetween. A bias voltage variable within a predetermined range is applied to the gate electrode so as to cause the convolver element to operate at the optimum convolution efficiency. A first mode signal is output when the variable bias voltage is in the proximity of either end of the predetermined range, and a second mode signal is output when the variable bias voltage is in a range defined by excluding the first range from the predetermined range. The variable bias voltage is applied to the convolver element when the second mode signal is output. When the first mode signal is output, the characteristics of the convolver element are controlled at an increased rate relative to a control rate when said variable bias voltage is used.

15 Claims, 9 Drawing Sheets

CONTROLLING APPARATUS FOR IMPROVING START UP TIME FOR A CONVOLVER

BACKGROUND OF THE INVENTION

1. Field of the Invention

The present invention relates to control of a surface acoustic wave (SAW) convolver element of a monolithic structure wherein a piezoelectric film, an insulating film and a semiconductor are laminated, and particularly, to a convolver controller for improving a start timing by controlling an operation of such an SAW convolver element.

2. Description of the Prior Art

An optimum bias circuit for generating a gate bias voltage (voltage applied across a gate electrode and a ground electrode) which maximizes the convolution efficiency to apply the bias voltage to a convolver element of the type mentioned above has been disclosed by Japanese Patent Public Disclosure No. 52509/1988 (Optimum Bias Circuit for Convolver) and No. 77177/1988 (Optimum Bias Circuit in Surface Acoustic Wave Apparatus).

These optimum bias circuits control a gate voltage $V_G$ in accordance with gate capacitance $C_G$ (capacitance across the gate electrode and the ground electrode) in order to make maximize the convolution efficiency $F_T$. Such a control method utilizes an approximately constant relationship between a $C_G-V_G$ characteristic and an $F_T-V_G$ characteristics, as will be understood from the convolver element (having an N-type substrate) of the type shown in FIG. 1. In more detail, it has been found that an approximately constant relationship exists between an $F_T-V_G$ curve FVC and a $C_G-V_G$ curve CVC in regard to a relative change in the gate voltage $V_G$, and that the optimum gate capacitance $C_{Gop}$ when the maximum convolution efficiency $F_{Tmax}$ is obtained is substantially constant regardless of any change in gate voltage $V_G$. Therefore, the optimum bias circuits explained above are structured such that characteristics of a particular convolver element to be used are measured, that the optimum value of gate capacitance $C_{Gop}$ (or a range of change thereof resulting from an allowable temperature change) for obtaining the maximum convolution efficiency ($F_{Tmax}$) in a stabilized operating condition is decides beforehand, that the optimum value $V_{Gop}$ of gate voltage $V_G$ corresponding to $C_{Gop}$ (or a range of change in $V_{Gop}$ resulting from a temperature change) is determined, and a range $V_L-V_H$ in which the gate bias voltage $V_B$ varies is determined so as to include the optimum value $V_{Gop}$ (or the range of change thereof).

Such optimum bias circuits as explained above are disadvantageous in that when a convolver element is started, as will be seen from a $V_B-t$ curve VTC and a $F_T-t$ curve FTC shown in FIG. 2, the time taken until the maximum convolution efficiency can be obtained, namely the warming-up time $T_W$, becomes unacceptably long (for example, several minutes or more at a low temperature).

It is because the $C_G-V_G$ characteristic and the $F_T-V_G$ characteristic of a convolver element are shifted (for example: ±10 volts) at the time of starting (refer to S2 in FIG. 3) from the range in the balanced condition (refer to S1 in FIG. 3) in regard to the absolute value of the gate voltage thereby causing the optimum gate voltage to be deviated from the range in which a predetermined gate bias voltage $V_B$ is variable.

In FIG. 3, the $C_G-V_G$ and $F_T-V_G$ characteristics in the balanced condition S1 are indicated by solid lines CVC1 and FVC1, while these characteristics in the shifted condition S2 are indicated by chain lines CVC2 and FVC2. Moreover, the optimum gate voltage $V_{Gop2}$ in the shifted condition greatly deviates from the range $V_L-V_H$ of $V_B$. A principal factor resulting in such characteristic shifts is, as is well known, a shift of an amount of electric charge in the piezoelectric film of a convolver element from the amount in the stable condition, and such a shift depends on the level of gate bias voltage previously applied and the length of time which has elapsed from the preceding use.

SUMMARY OF THE INVENTION

It is an object of the invention to provide a control apparatus for a convolver element having a gate electrode, an earthed electrode and a piezoelectric layer therebetween, and which can reduce a time for warming up the convolver element.

The present invention has been made to provide a control apparatus for a convolver device including a surface acoustic wave convolver element having a gate electrode, an earthed electrode and a piezoelectric layer therebetween and a bias voltage means for applying a bias voltage variable within a predetermined range between the gate and grounded electrodes so as to cause said convolver element to operate at an optimum convolution efficiency. The control apparatus comprises:

operating mode designating means connected to receive the variable bias voltage for outputting a first mode signal when the variable bias voltage is in a first range in the proximity of either end of the predetermined range and a second mode signal when the variable bias voltage is in a second range defined by excluding the first range from the predetermined range; and control means connected to receive the output of the operating mode designating means and the variable bias voltage for applying the variable voltage to the convolver element when the operating mode designating means outputs the second mode signal and for controlling, when the operating mode designating means outputs the first mode signal, the characteristics of the convolver element at a higher speed than at a speed indicated when the variable bias voltage is used, thereby causing the maximum convolution efficiency to be achieved at a voltage within the predetermined range.

In this embodiment, the control means controls a speed of change in electric charge in the convolver element when the first mode signal is output.

In accordance with a first embodiment of the present invention, the control means controls a voltage applied between the gate and grounded electrodes of the convolver element.

The control means may comprise:

voltage generating means for generating at least one fixed bias voltage set outside the predetermined range; and switch means connected to receive the fixed bias voltage, the variable bias voltage and the output of the operating mode designating means and operable to cause the fixed bias voltage when the first mode signal is output and the variable bias voltage when the second mode signal is output to be supplied to the gate electrode of the convolver element.

The voltage generating means may include a first generating means for generating a first fixed bias voltage higher than the upper limit of the predetermined range and a second generating means for generating a second fixed bias voltage lower than the lower limit of the predetermined range, and the switch means may be operable to cause the first fixed bias voltage when the variable bias voltage is in the proximity of the upper limit and the second fixed bias voltage when the variable bias voltage is in the proximity of the lower limit to be supplied to the gate electrode of the convolver element.

Alternatively, the control means may comprise:

voltage generating means for generating a fixed bias voltage higher than the upper limit of the predetermined range; and switch means connected to receive the fixed bias voltage, the variable bias voltage and the output of the operating mode designating means and operable to cause the fixed bias voltage when the first mode signal is output and the variable bias voltage when the second mode signal is output to be supplied to the gate electrode of the convolver element.

Alternatively, the control means may comprise:

voltage generating means for generating a fixed bias voltage lower than the lower limit of the predetermined range; and switch means connected to receive the fixed bias voltage, the variable bias voltage and the output of the operating mode designating means and operable to cause the fixed bias voltage when the first mode signal is output and the variable bias voltage when the second mode signal is output to be supplied to the gate electrode of the convolver element.

In accordance with a second embodiment of the present invention, the control means controls the resistivity of the piezoelectric layer of the convolver element when the first mode signal is output. In this embodiment, the control apparatus may control a temperature of the convolver element when the first mode signal is output. The control means may comprise:

heater means for heating the convolver element; and switch means connected to receive the output of the operating mode designating means and operable to cause the heater means to be energized when the designating means outputs the first mode signal and to cause the heater means to be deenergized when the designating means outputs the second mode signal.

In accordance with a third embodiment of the present invention, the control means controls both a voltage applied to the gate electrode of the convolver element and the resistivity thereof. The control means may comprise:

voltage generating means for generating at least one fixed bias voltage outside the predetermined range;

first switch means connected to receive the fixed bias voltage, the variable bias voltage and the output of the operating mode designating means and operable to cause the fixed bias voltage when the first mode signal is output and the variable bias voltage when the second mode signal is output to be supplied to the gate electrode of the convolver element;

heater means for heating the convolver element;

voltage source means connectable to the heater means; and second switch means connected to receive the output of the operating mode designating means and operable to connect the heater means to the voltage source means when the first mode signal is output and to disconnect the heater means from the voltage source means when the second mode signal is output.

The voltage generating means may include a first generating means for generating a first fixed bias voltage higher than the upper limit of the predetermined range and a second generating means for generating a second fixed bias voltage lower than the lower limit of the predetermined range, and the first switch means may be operable to cause the first fixed bias voltage when the bias voltage is in the proximity of the upper limit of the range and the second fixed bias voltage when the bias voltage is in the proximity of the lower limit of the range to be supplied to the gate electrode of the convolver element.

Alternatively, the control means may comprise:

voltage generating means for generating a fixed bias voltage higher than the upper limit of the predetermined range;

first switch means connected to receive the fixed bias voltage, the variable bias voltage and the output of the operating mode designating means and operable to cause the fixed bias voltage when the first mode signal is output and the variable bias voltage when the second mode signal is output to be supplied to the gate electrode of the convolver element;

heater means for heating the convolver element;

voltage source means connectable to the heater means; and second switch means connected to receive the output of the operating mode designating means and operable to connect the heater means to the voltage source means when the first mode signal is output and to disconnect the heater means from the voltage source means when the second mode signal is output.

Alternatively, the control means may comprise:

voltage generating means for generating a fixed bias voltage lower than the lower limit of the predetermined range;

first switch means connected to receive the fixed bias voltage, the variable bias voltage and the output of the operating mode designating means and operable to cause the fixed bias voltage when the first mode signal is output and the variable bias voltage when the second mode signal is output to be supplied to the gate electrode of the convolver element;

heater means for heating the convolver element;

voltage source means connectable to the heater means; and second switch means connected to receive the output of the operating mode designating means and operable to connect the heater means to the voltage source means when the first mode signal is output and to disconnect the heater means from the voltage source means when the second mode signal is output.

The above and other objects and advantages of the invention will become clearer from the following description of embodiments taken in connection with the accompanying drawings.

DETAILED DESCRIPTION OF THE PREFERRED EMBODIMENTS:

A convolver controlling apparatus of the present invention controls characteristics of a convolver element in such an operation mode as the starting mode at a speed higher than that obtained by a given gate bias voltage.

Figure 4:
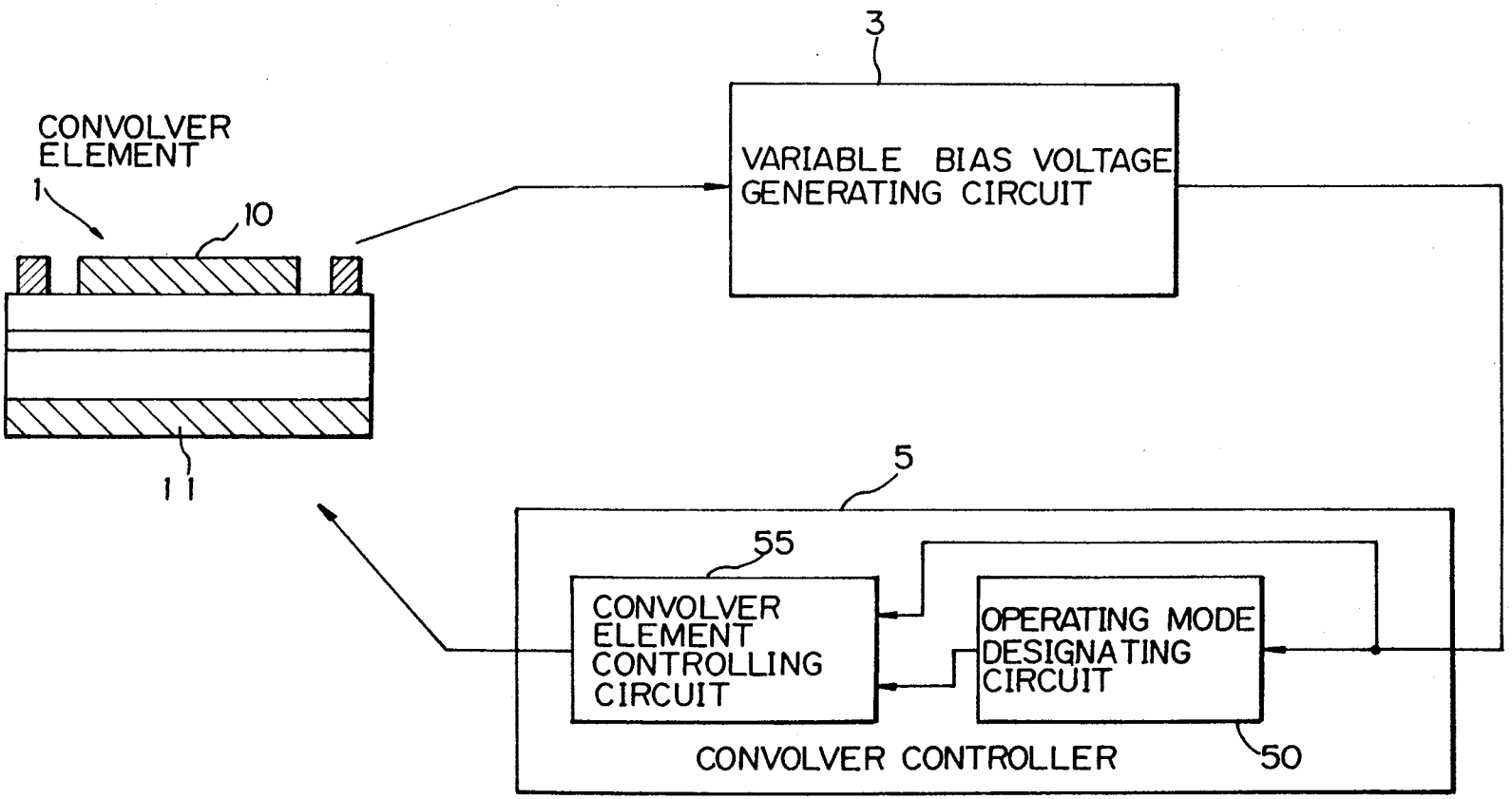
FIG. 4 schematically shows a basic construction of a control apparatus for a convolver device according to the present invention.

FIG. 4 indicates a basic structure of the convolver controlling apparatus according to the present invention.

In FIG. 4, a convolver device is shown to comprise (A) an acoustic surface wave convolver element 1 including a gate electrode 10 and an earthed electrode 11, and (B) a variable bias voltage generator 3 for generating a variable basis voltage to be applied between the gate electrode 10 and the earthed electrode 11. A range in which the variable bias voltage varies is defined by predetermined upper and lower limit values.

A convolver controlling apparatus 5 of the present invention for controlling an operation of the convolver device comprises: (a) an operating mode designating circuit 50 which is connected to receive a variable bias voltage for outputting a first mode signal indicating the first mode when a value of the variable bias voltage is in a first condition in which the variable bias voltage is in the vicinity of the upper or lower limit value of the voltage varying range and a second mode signal indicating the second mode when a value of the variable bias voltage is in a second condition other than the first condition; and (b) a convolver element control circuit 55 connected to receive an output from the operating mode designating circuit 50 and the variable bias voltage for applying the variable bias voltage to the convolver element 1 when the operating mode designating circuit 50 outputs the second mode signal and for controlling the element characteristics of the convolver element 1, at a speed higher than the speed obtained when using the variable bias voltage, in such a direction that maximum convolution efficiency may be obtained, with a bias voltage within the voltage varying range when the operating mode designating circuit 50 outputs the first mode signal.

Consequently, a speed for controlling the element characteristics may be enhanced in the case of such a condition as the starting time.

According to the present invention, the convolver element control circuit 55 may control a speed of change in electric charge in the convolver element 1 in the case of the first mode.

Specifically, according to the present invention, the convolver element control circuit 55 may control a voltage between the gate electrode 10 and the grounded electrode 11 of the convolver element 1 in the case of the first mode. In this case, the element control circuit 55 comprises: (a) a fixed bias voltage generating circuit for generating a fixed bias voltage having a value outside the voltage varying range; and (b) a switch which is connected to receive the fixed bias voltage, the variable bias voltage and the output of the operating mode designating circuit for outputting, as a bias voltage between the gate electrode and the earthed electrode of the convolver element 1, the variable bias voltage when the operating mode designating circuit 50 outputs the second mode signal and the fixed bias voltage when the operating mode designating circuit 50 outputs the first mode signal. In this case, (a) the operating mode designating circuit 50 generates the first mode signal responding to the first condition in which a value of the variable bias voltage is in the vicinity of either of the upper limit value or lower limit value and (b) the fixed bias voltage has a voltage value smaller than the lower limit of the voltage varying range or larger than the upper limit of the voltage varying range. Alternatively, (a) the operating mode designating circuit 50 generates a first signal responding to a first condition where the variable bias voltage is in the vicinity of the upper limit value and a second signal responding to a second condition where the variable bias voltage is in the vicinity of the lower limit; (b) the fixed bias voltage generating circuit comprises a first voltage generating circuit for generating a first fixed bias voltage which is higher than the upper limit value and a second voltage generating circuit for generating a second fixed bias voltage which is lower than the lower limit value; and (c) the switch selectively outputs the first fixed bias voltage responding to the first signal and the second fixed bias voltage responding to the second signal.

According to the present invention, the convolver element control circuit 55 may control, in the first mode, the resistivity of the piezoelectric film of the convolver element 1. To do this, the convolver element control circuit 55 may control a temperature of the convolver element 1 in the case of the first mode.

In this case, the convolver element control circuit 55 comprises: (a) a means for applying the variable bias voltage to the convolver element 1 as a bias voltage between the gate electrode and the grounded electrode; (b) a heater for heating the convolver element 1; and (c) a switch connected to receive the output of the operating mode designating circuit 50 and operable to energize the heater when the operating mode designating circuit 50 outputs the first mode signal or deenergize the heater when the operating mode designating circuit outputs the second mode signal.

According to the present invention, the convolver element control circuit 55 may control a voltage between the gate electrode and the grounded electrode and the resistivity of the piezoelectric film of the convolver element 1.

In this case, the convolver element control circuit 55 comprises: (a) a fixed bias voltage generating circuit for generating a fixed bias voltage having a value outside the voltage varying range; (b) a first switch connected to receive the fixed bias voltage, the variable bias voltage and the output of the operating mode designating circuit 50 and operable to output the variable bias voltage when the operating mode designating circuit outputs the second mode signal and the fixed bias voltage when the operating mode designating circuit outputs the first mode signal as a bias voltage between the gate electrode and the grounded electrode of the convolver element 1; (c) a heater for heating the convolver element 1; and (d) a second switch connected to receive the output of the operating mode designating circuit and operable to energize the heater when the operating mode designating circuit outputs the first mode signal and deenergize the heater when the operating mode designating circuit outputs the second mode signal.

In this case, (a) the operating mode designating circuit may generate the first mode signal responding to the first condition where the variable bias voltage is in the vicinity of the upper limit or lower limit value, and (b) the fixed bias voltage has a voltage value lower than the lower limit of the voltage varying range or higher than the upper limit of the voltage varying range. Alternatively, (a) the operating mode designating circuit generates a first signal responding to a first condition where the variable bias voltage is in the vicinity of the upper limit value and a second signal responding to a second condition where the variable bias voltage is in the vicinity of the lower limit value; (b) the fixed bias voltage generating circuit comprises a first voltage generating means for generating a first fixed bias voltage higher than the upper limit value and a second voltage generating means for generating a second fixed bias voltage lower than the lower limit value; (c) the first switch outputs the first fixed bias voltage responding to the first signal and the second fixed bias voltage responding to the second signal; and (d) the second switch energizes the heater responding to the first or second signal.

Next, a first embodiment of a convolver controlling apparatus according to the present invention will be explained with reference to FIGS. 3 and 5. This first embodiment uses the gate bias voltage as a parameter for controlling the characteristics of the convolver element.

First, the convolver element 1 and an optimum bias circuit 30 operating as the variable bias voltage generating circuit 3 will be explained.

The convolver element 1 has a triple-layer structure comprising an N-type semiconductor substrate 12, an insulation film 13 and a piezoelectric film 14. The upper surface of the piezoelectric film is provided with two pairs of comb-type electrodes 15, 16 (illustrated schematically) in addition to the gate electrode 10, while the lower surface of the substrate 12 with the earthed electrode 11. Each pair of the comb-type electrodes 15, 16 are respectively connected to two pairs of input terminals 18, 19 (illustrated schematically) to which signals to be convoluted are supplied. An output terminal 20 of this element is connected to the gate electrode 10 via an output matching circuit 21.

The optimum bias circuit 30 may be any type of circuit structures as disclosed in Japanese Patent Public Disclosure No. 52509/1988 and 77177/1988.

The optimum bias circuit 30 shown in block diagram comprises an input terminal 300 connected to the gate electrode 10, an output terminal 302 carrying a gate bias voltage $V_B$, a capacitance difference detector 304, a bias voltage controller 306 and a bias voltage generator 308. The capacitance difference detector 304 detects a gate capacitance $C_G$ between the gate electrode 10 and the earthed electrode 17, compares the detected capacitance with a reference predetermined optimum gate capacitance value $C_{Gop}$ (namely, a value resulting in the maximum convolution efficiency) and generates a capacitance difference signal indicating polarity and amplitude of the capacitance difference. This capacitance difference detector 304 may be formed, for example, from a combination of an impedance bridge and a signal source for bridge as disclosed in Japanese Patent Public Disclosure No. 52509/1988 or No. 77177/1988 or a combination of a phase circuit and an oscillation signal source as disclosed in Japanese Patent Application No. 221074/1988. In order to change the bias voltage $V_B$ at the output terminal 302 in such a direction that the capacitance difference reduces, depending on polarity and amplitude of the capacitance difference, the bias voltage controller 306 which receives the capacitance difference signal from the detector 304 generates a control signal which indicates the polarity and amplitude of such a change in $V_B$. As described in the Japanese documents referred to above, this controller may be formed to comprise a phase detector or a phase comparator. The bias voltage generator 308 receiving the control signal operates to generate the bias voltage value $V_B$ which is changed depending on the polarity and amplitude of such a control signal. The bias voltage generator 308 may be realized by, for example, a combination of a DC amplifier and an integrator or a combination of a charge pump circuit and a low-pass filter. As shown in FIG. 3, a range W2 ($=V_L-V_H$) where the bias voltage $V_B$ varies includes a predetermined allowable range W1 of the optimum gate voltage (namely $V_{Gop1}$) which varies due to a change in temperature in the balanced condition S1. As an example, in case $V_{Gop1}$ changes in a range of ($-3\pm5$) volts, $V_L$ is set to $-10$ volts, while $V_H$ to $+10$ volts.

So long as $V_{Gop}$ changes within this range W2, the optimum bias circuit 30 can realize $F_{Tmax}$ of the element 1. However, when $V_{Gop}$ deviates from the range W2 to a value $V_{Gop2}$ as indicated by a symbol S2, the warming-up time $T_W$ in which the characteristics CVC2 and FVC2 shift toward the characteristics CVC1 and FVC1 in the balanced condition S1 thereby causing $V_{Gop2}$ to be in the range W2 is necessary for obtaining $F_{Tmax}$ in the bias voltage range W2. The present invention operates to reduce this warming-up time, as explained hereunder.

Figure 5:
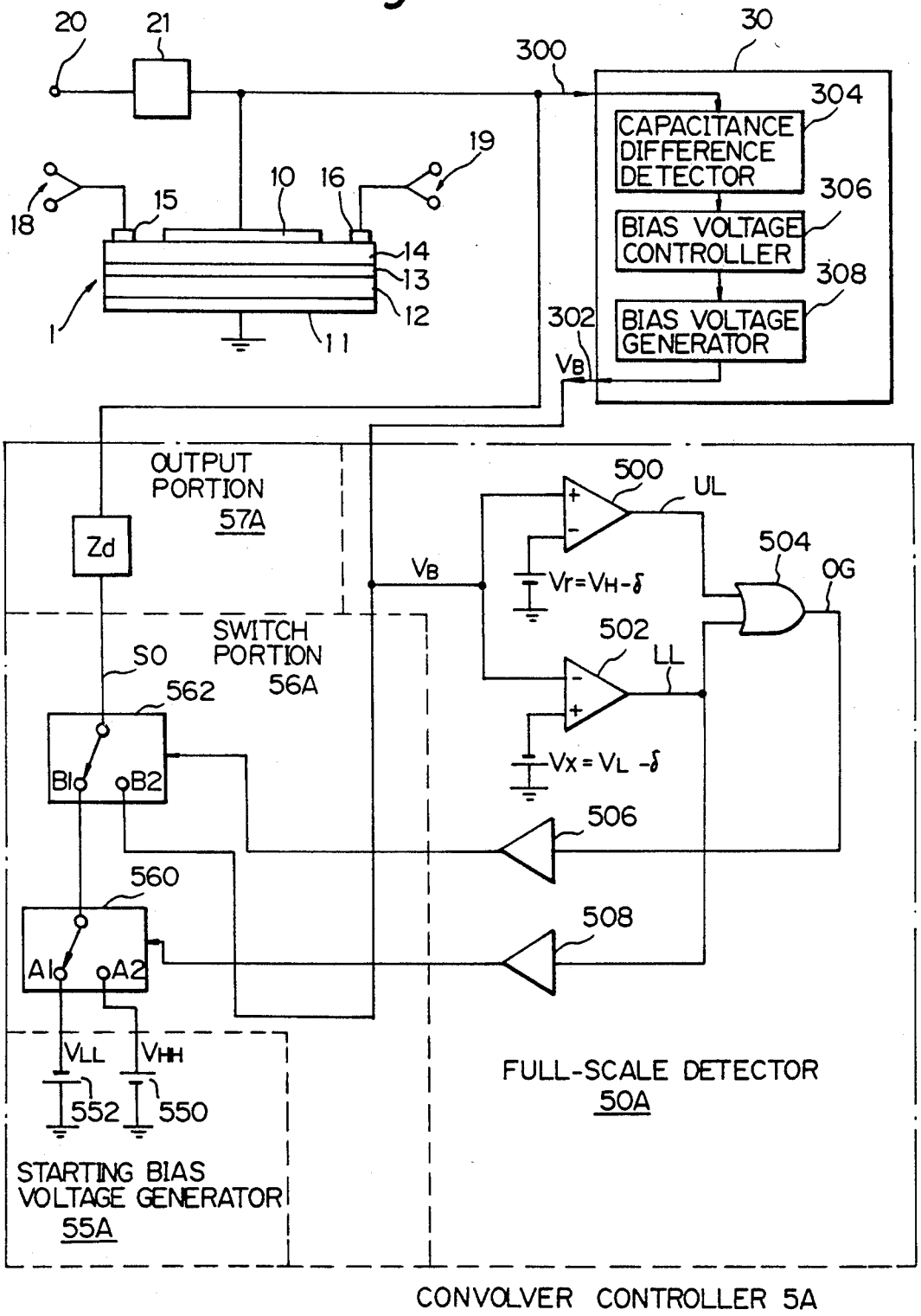
FIG. 5 is a schematic diagram showing the construction of a first embodiment of a control apparatus according to the present invention.

FIG. 5 further shows a convolver controller 5A connected between the optimum bias circuit 30 and the gate electrode 10. This controller 5A includes a full-scale detector 50A (operating mode designating circuit 50), a starting bias voltage generator 55A (convolver element control circuit 55), a switch portion 56A and an output portion 57A. The convolver element has characteristics which tend to shift from the position S1 of the balanced condition to a lower voltage side and to a higher voltage side.

As shown in FIG. 5, the full-scale detector 50A detects whether the received bias voltage $V_B$ is located in the vicinity of the upper limit W3 of the range W2, or in the vicinity of the lower limit W4 or in a range W5 between W3 and W4. In more detail, the detector 50A is provided with a pair of comparators 500 and 502. The comparator 500 receives a bias voltage $V_B$ at the non-inverted input terminal for detection of the fact that $V_B$ is in the vicinity of the upper limit W3, and a threshold voltage $V_Y$ at the inverted input terminal W2, $V_Y$ being smaller by a value $\delta$ (example: 0.1 volts or less) than the upper limit value $V_H$, and outputs a comparison resultant signal UL. This signal UL becomes high when $V_B \geqq V_Y$, and low when $V_B < V_Y$. Meanwhile, the comparator 502 receives a bias voltage $V_B$ at the inverted input terminal for detection of the fact that $V_B$ is in the vicinity of the lower limit W4 and a threshold voltage $V_X$ at the non-inverted input terminal, $V_X$ being larger by a value $\delta$ than the lower limit value $V_L$ of W2, and outputs a comparison resultant signal LL. This signal LL becomes high when $V_B \leqq V_X$, and low when $V_B > V_X$.

These comparison resultant signals UL, LL are received by an OR gate 504. An output OG thereof becomes high when $V_B$ is in either of the ranges W3 and W4, indicating the starting mode, and becomes low when $V_B$ is in the range W5, indicating an ordinary operation mode in which the bias voltage $V_B$ is used. This signal OG is output through a driver 506. Moreover, the output signal LL of the comparator 502 also appears as an output from a driver 508 and is used, in the starting mode, for recognizing whether $V_B$ is in the vicinity of the upper limit W3 or in the vicinity of the lower limit W4.

The starting bias voltage generator 55A comprises a couple of DC voltage sources 550, 552, respectively generating the starting bias voltages $V_{HH}$, $V_{LL}$. The voltage $V_{HH}$ is set to a value, for example, +20 volts, larger than the upper limit value $V_H$. Meanwhile the voltage $V_{LL}$ is set to a value, for example, −20 volts, smaller than the lower limit $V_L$.

The switch portion 56A includes a couple of switches 560, 562. The switch 560 is connected so that it receives the voltages $V_{HH}$, $V_{LL}$ at input terminals A1, A2, as well as the output signal LL at a control terminal through the driver 508. The switch 560 is connected to the terminal A1 when the output signal LL is high and to the terminal A2 when LL is low. The switch 562 respectively receives an output from the switch 560 and the bias voltage $V_B$ at the input terminals B1, B2, as well as the output signal OG at a control terminal through the driver 506. The switch 562 is connected to the terminal B1 when the output signal OG is high and to the terminal B2 when OG is low and thereby generates an switch output SO.

The output portion 57*a* comprises a fixed impedance Zd for applying the output SO of the switch 562 between the gate electrode 10 and the grounded electrode 11. This impedance Zd allows a DC component to pass through but shows a large resistance against an AC signal component for gate capacitance detection.

An operations of the convolver controlling apparatus shown in FIG. 5 having the structure explained above will be explained with reference to FIGS. 3 and 6. For convenience of explanation, the element characteristics of the convolver element 1 are assumed, as shown in FIG. 3, to have been shifted to the position S2 from the position S1 of the balanced condition.

Figure 6:
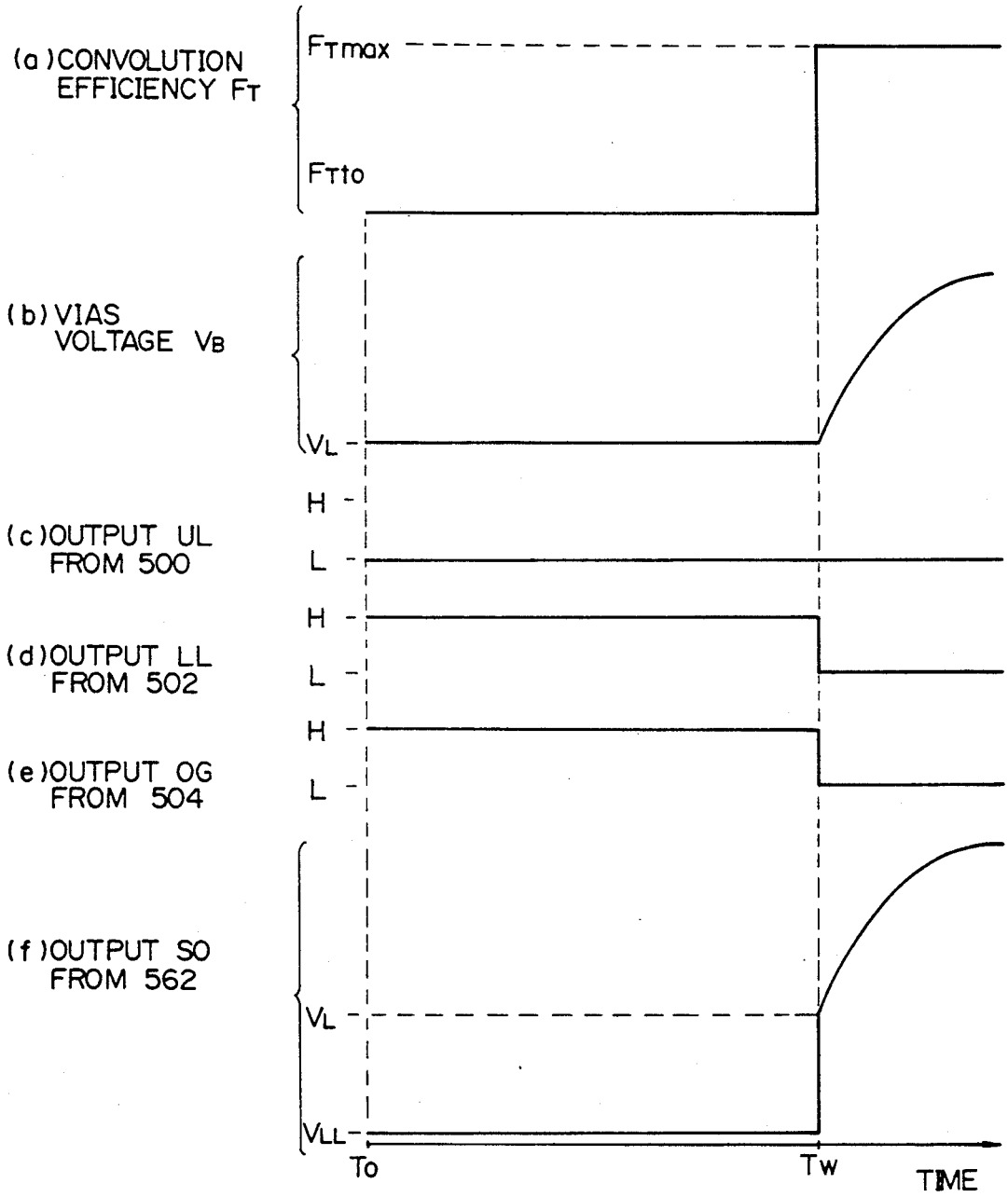
FIG. 6 shows a change in convolution efficiency and waveforms appearing at various points in the control apparatus shown in FIG. 5.

Immediately after a starting time $T_O$, the optimum bias circuit 30 detects a gate capacitance value $C_G$ on the CVC2 curve and outputs the lower limit value $V_L$ as the bias voltage $V_B$ [FIG. 6(*b*)] because even $C_G$ at the lower limit value $V_L$ (namely $C_{Glo}$) is larger than $C_{Gop}$ in the range W2. $F_T$ is a very small value $F_{Flo}$ [FIG. 6(*a*)]. In this case, the output signal UL of the comparator 500 is low [FIG. 6(*c*)] and the output signal LL of the comparator 500 is high [FIG. 6(*d*)]. Therefore, the output signal OG is high [FIG. 6(*e*)] and the switches 560, 562 are set to the terminals A1, B1. As a result, the switch output SO is equal to the voltage $V_{LL}$ [FIG. 6(*f*)].

This condition continues while the element characteristics shift from the position S1 to the position S2. However, this shift is carried out at a higher speed because the electric charge in the piezoelectric film of the convolver element 1 is changed quickly by using $V_{LL}$ in place of $V_L$. At the end of the warming-up time $T_W$ when $V_{Gop2}$ reaches the value $V_L$, the element characteristics continue to shift toward the position S1. Therefore, the optimum bias circuit 30 changes the voltage $V_B$ in such a direction that $V_B$ becomes larger than the lower limit value $V_L$. As a result, the comparator output signal LL immediately becomes low and the output signal OG also becomes low. The output signal OG at low level sets the switch 562 to the terminals A2, B2 to generate the voltage $V_B$ as the output signal SO. The warming-up time $T_W$ may be reduced to, for example, less than 1 minute whereas a conventional convolver apparatus take several minutes or longer for warming-up the element. Thereafter, an operation similar to that of the conventional apparatus is performed and $F_{Tmax}$ is maintained by using a voltage in the range W2.

If the characteristics of the convolver element have shifted further from S2 to the lower voltage side at the time of starting, and the FVC2 curve has shifted to the left side from the voltage $V_{LL}$, the waveform of $F_T$ shown in FIG. 6(*a*) has in the area from $T_O$ to $T_W$ a convex portion corresponding to a peak generated when the FVC2 characteristic passes the voltage $V_{LL}$, and $F_T$ suddenly rises sharply as shown in FIG. 6(*a*) at the time $T_W$.

Figure 3:
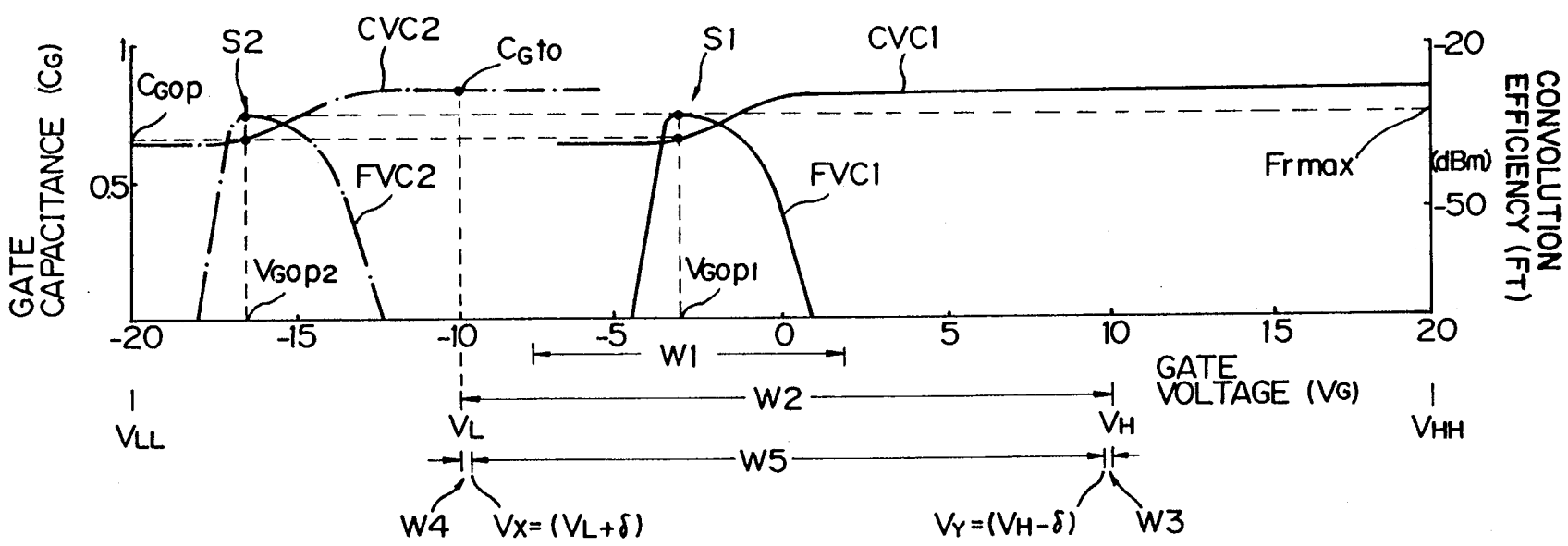
FIG. 3 is a graph used to explain a basic concept of the present invention and showing changes in gate capacitance and convolution efficiency relative to a gate voltage wherein a position S1 corresponding to the balanced state of a convolver element is indicated by a solid line and a position S2 shifted from the position S1 is indicated by a chain line.

It is noted that in FIG. 3, the FVC2 curve is shown, for simplification, in the shape similar to and having the same width as the FVC1 curve of the balanced condition. In fact, the FVC2 curve may have wider skirt area than the FVC1 curve, but, the operation of the convolver controlling apparatus is still similar to that shown in FIG. 6, although a part of the waveform $F_T$ slightly changes from $T_O$ to $T_W$.

It is understood that the explanation about the case where the element characteristics have shifted to the lower voltage side can also be applied to the case where the element characteristics have shifted to the higher voltage side.

Figure 7:
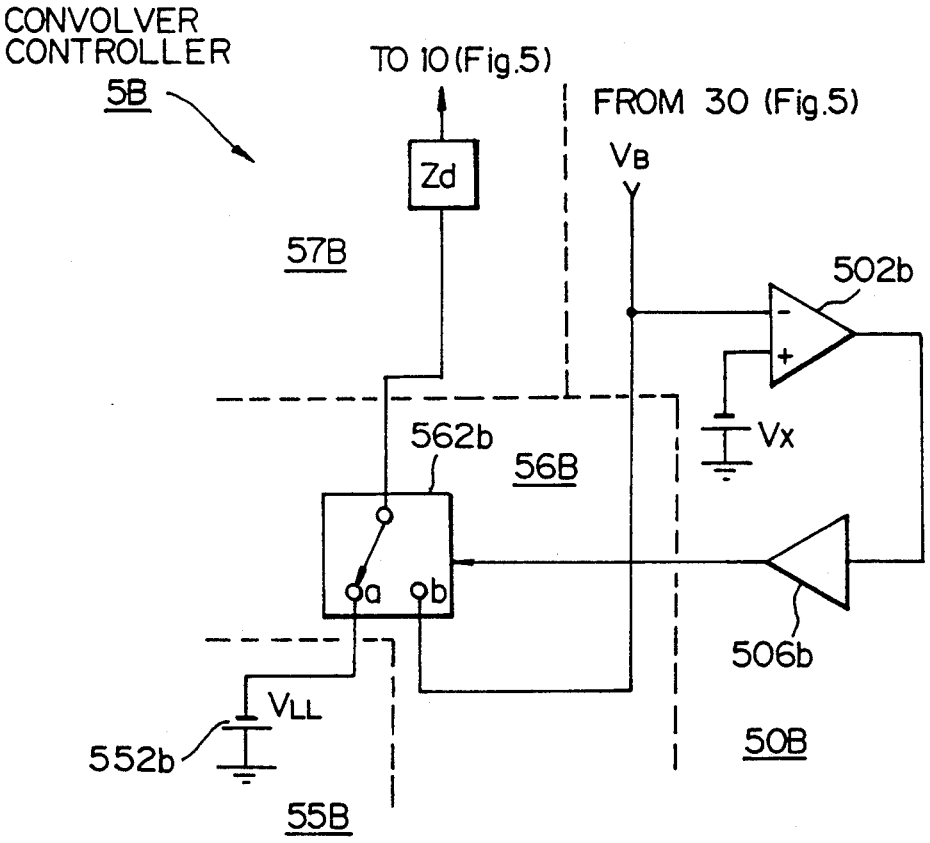
FIG. 7 shows a variation to the control apparatus shown in FIG. 5.

A variation on the first embodiment of the convolver controlling apparatus will next be explained with reference to FIG. 7. This figure shows a convolver controller 5B which replaces the controller 5A of FIG. 5. Such a convolver controller can be applied to a convolver element of a type where the element characteristics shift to the higher voltage side or to the lower voltage side from the balanced condition. The convolver controller 5B shown in FIG. 7 is applicable to a convolver element having such characteristics as shift only to the lower voltage side. The elements corresponding to those in FIG. 5 are designated by the same numerals followed by a letter "b". An operation of the circuit shown in FIG. 7 is substantially the same as that explained with reference to FIG. 5 and therefore a detailed explanation thereof is omitted here.

If the convolver controller 5A shown in FIG. 5 is applied to a convolver element having such characteristics as shift to the higher voltage side, it is necessary to replace the power supply 552*b* with a power supply generating the voltage $V_{HH}$ and the comparator 502*b* with a comparator 500*b* (not shown).

A second embodiment of a convolver controlling apparatus will now be explained with reference to FIG. 8. This embodiment is intended to control a speed of change in the electric charge in the convolver element 1 by changing the resistivity of the piezoelectric film 14 in order to control characteristics of the convolver element, and the convolver element to which the convolver controller of the present embodiment is applicable is of a type having such characteristics as can shift to both lower and higher voltage sides from the balanced position S1 as in the case of FIG. 5. A difference of this embodiment from that shown in FIG. 5 is that a convolver controller 5C is used in place of the convolver controller 5A. The remainder is the same as that in FIG. 5. Therefore, only the controller 5C is explained hereunder.

Figure 8:
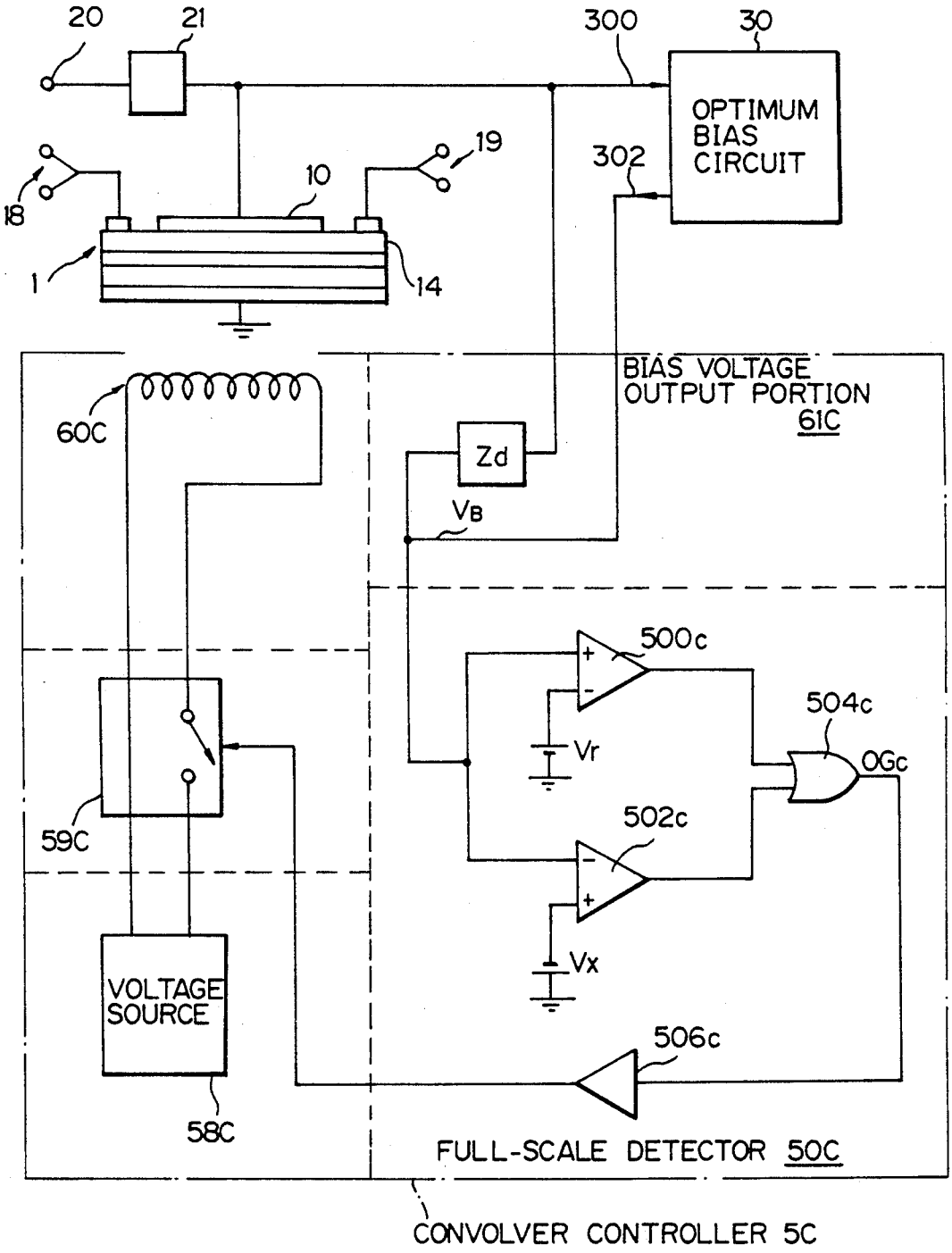
FIG. 8 is a schematic diagram showing the construction of a second embodiment of a control apparatus according to the present invention.

The convolver controller 5C comprises, as shown in FIG. 8, a full-scale detector 50C (operating mode designating means 50), an AC or DC power source 58C (convolver element control means 55), a switch 59C which may be formed by relay, transistor, SCR and the like, a heater 60C which may be realized by a resistance lead, a thin film resistor or a Peltier element, and a bias voltage output portion 61C.

The full-scale detector 50C is similar to the fullscale detector 50A except that the driver 508 is eliminated, and thus the circuits corresponding to those in FIG. 5 are designated by the same reference numerals followed by a letter "c". In the convolver controller 5C, the bias voltage $V_B$ is always supplied to the gate electrode 10 through the fixed impedance Zd in the bias voltage output portion 61C.

The switch 59C is connected between the power source 58C and the heater 60C in order to turn ON/-OFF the heater. The switch 59C closes and turns on the heater when the output of the OR gate 504C becomes high, and opens and turns off the heater when the output of the OR gate becomes low.

Figure 1:
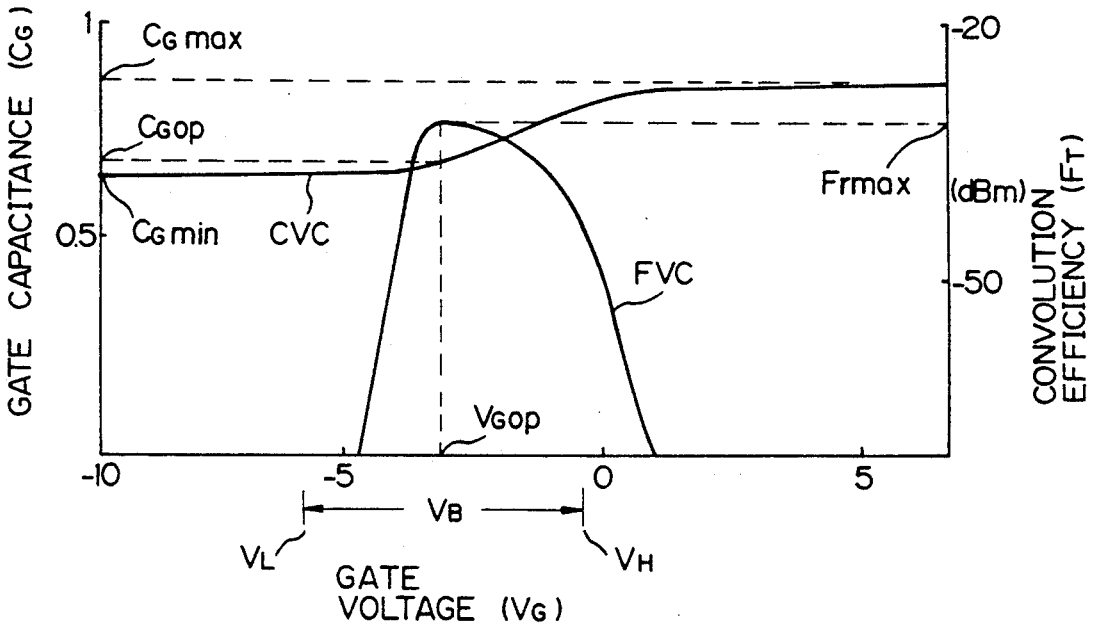
FIG. 1 is a graph showing characteristics of a surface acoustic wave convolver element.
Figure 2:
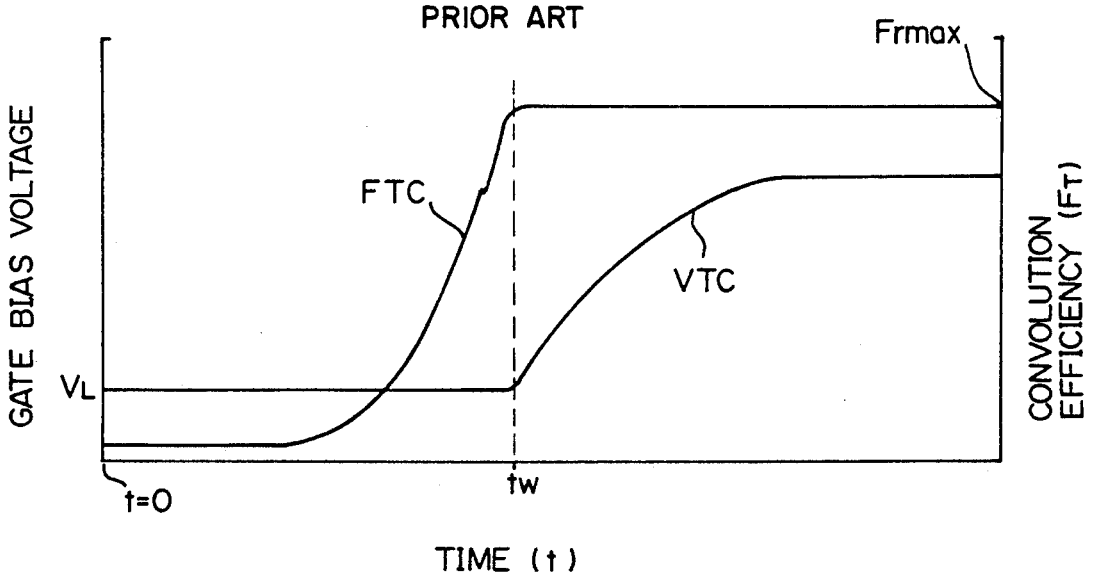
Fig. 2 PRIOR ART
FIG. 2 is a graph showing changes in gate bias voltage $V_G$ and convolution efficiency $F_T$ relative to the time when a convolver element is activated by an optimum bias circuit of the prior art.

In operation, when the bias voltage $V_B$ is in the range W3 or W4, the convolver element 1 is heated and an ordinary bias voltage is applied to the gate electrode 10. Accordingly, the resistivity of the piezoelectric film 14 is lowered and the speed of change in electric charge in the element substantially increases even in the condition of using such an ordinary bias voltage. On the other hand, when the bias voltage $V_B$ enters in the range W5, the heating of the convolver element 1 stops and the resistivity of piezoelectric film returns to the ordinary value. The remaining elements operate as indicated in FIGS. 6(*a*)–(*e*). However, the waveform of FIG. 6(*a*) does not rise sharply at the time $T_W$ but rises gradually like the FTC curve shown in FIG. 2.

The convolver controller 5C shown in FIG. 8 can also be applied to a convolver element of a type having such element characteristics as shift from the balanced position S1 to either one of the higher and lower voltage sides. In case the second embodiment is applied to a convolver element having the characteristics which tend to shift to the lower voltage side in FIG. 3, the output of the comparator 502*c* is applied directly to the driver 506*c*, and the circuit elements 500*c*, 504*c* are omitted. On the other hand, in case this embodiment is applied to a convolver element having the characteristics which tend to shift to the higher voltage side, the output of the comparator 502*c* is coupled directly to the driver 506*c* and the elements 500*c*, 504*c* are omitted.

Figure 9:
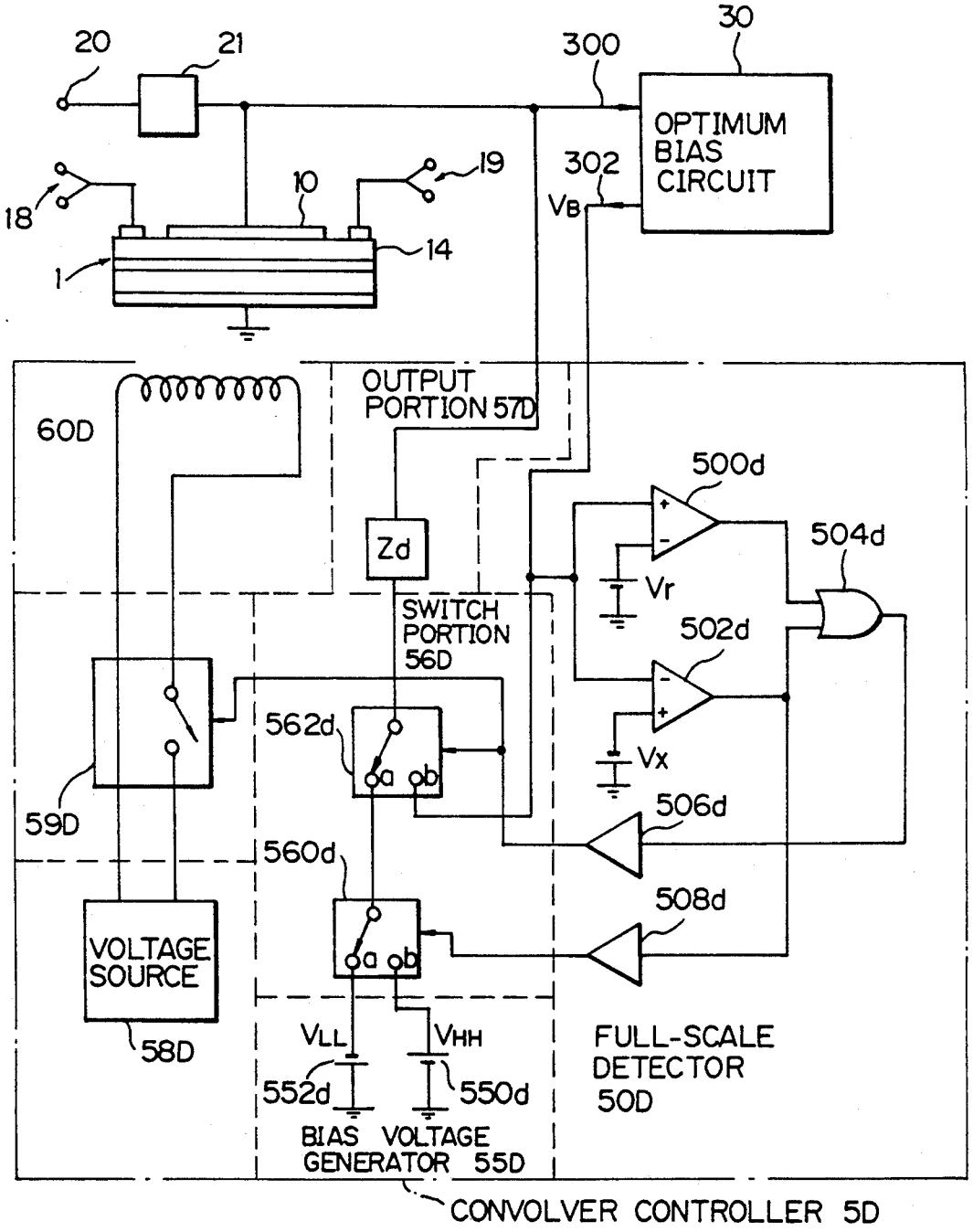
FIG. 9 is a schematic diagram showing the construction of a third embodiment of a control apparatus according to the present invention.

A third embodiment of a convolver controlling apparatus will now be explained with reference to FIG. 9. This embodiment is intended to control a change in speed of electric charge in the convolver element 1 by changing both the gate voltage and the resistivity of the piezoelectric film 14 to control characteristics of the convolver element. In other words, the third embodiment may be obtained by combining the embodiment of FIG. 5 and that of FIG. 8. With such combination, the speed of change in the electric charge is further enhanced and thereby the warming-up time can be further shortened.

A convolver controller 5D of this third embodiment comprises a full-scale detector 50D, a starting bias voltage generator 55D, a switch 56D and an output portion 57D respectively corresponding to the circuits 50A, 55A, 56A and 57A in FIG. 5. Moreover, corresponding to the circuits 58C, 59C, 60C in FIG. 8, a power source 58D, a switch 59D and a heater 60D are also provided. In the convolver controller 5D, the output of the driver 506*d* is applied to the control terminals of switches 562*d* and 59D.

An operation of this convolver controller 5D may be summarized as follows. When the bias voltage $V_B$ is in the range W3, the starting bias voltage $V_{HH}$ is applied through the switches 560*d*, 562*d* and impedance Zd to the gate electrode 10 and the heater 60D is turned ON to heat the convolver element 1. Meanwhile, when the bias voltage $V_B$ is in the range W4, the starting bias voltage $V_{LL}$ is applied to the gate electrode 10 and the heater 60D is turned ON to heat the convolver element 1. When the bias voltage $V_B$ enters in the range W5, the bias voltage $V_B$ is applied through the switch 562*d* and impedance Zd to the gate electrode 10 and the heater 60D is turned OFF to stop the heating.

Appropriate modifications can be made to the third embodiment to be applied to a convolver element having the characteristics which shift in either one of the higher or lower voltage side.

Figure 10:
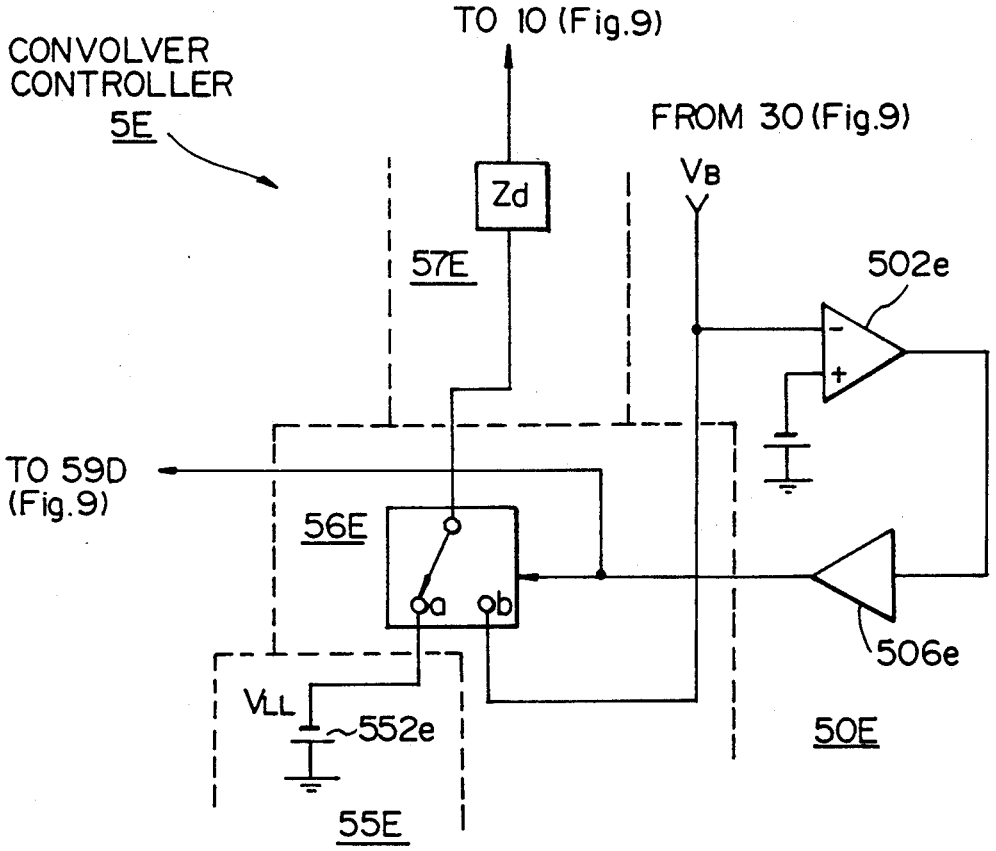
FIG. 10 shows a variation to the control apparatus shown in FIG. 9.

FIG. 10 shows a convolver controller 5E which is a variation on the convolver controller 5D. The convolver controller 5E comprises a full-scale detector 50E, a starting bias voltage generator 55E, a switch 56E and an output portion 57E respectively corresponding to the circuits 50B, 55B, 56B, 57B in FIG. 7. The output of a driver 506*e* is applied to the switch 56E and the switch 59D (FIG. 6). The remaining portions corresponding to 58D, 59D and 60D operate similarly to those in FIG. 6.

Various embodiments of the present invention have been explained and these can also be applied to a convolver element having a P type substrate.

According to the convolver controlling apparatus of the present invention, the warming-up time for staring the operation of a convolver element can be remarkably shortened without any increase in power consumption. Since power consumption is not increased, the convolver controlling apparatus of the present invention is suitable for a convolver apparatus of an IC type.

What is claimed is:

1. A control apparatus for a convolver device including a surface acoustic wave convolver element having a gate electrode, a grounded electrode and a piezoelectric layer therebetween and a bias voltage means for applying a bias voltage variable within a predetermined range between the gate and grounded electrodes so as to cause said convolver element to operate at an optimum convolution efficiency, said control apparatus comprising:

operating mode designating means connected to receive said variable bias voltage for outputting a first mode signal when the variable bias voltage is in a first range defined by end portions of the predetermined range and a second mode signal when the variable bias voltage is in a second range defined by excluding said first range from said predetermined range; and control means responsive to the output of said voltage for applying said variable voltage to said convolver element when said operating mode designating means outputs said second mode signal and for controlling, when said operating mode designating means outputs said first mode signal, said convolver element at an increased rate relative to a control rate when said variable bias voltage is used, thereby causing the maximum convolution efficiency to be achieved at a voltage within said predetermined range.

2. The control apparatus as set forth in claim 1 wherein said control means controls a speed of change in electric charge in said convolver element when said first mode signal is output.

3. The control apparatus as set forth in claim 2 wherein said control means controls a voltage applied between the gate and grounded electrodes of said convolver element.

4. The control apparatus as set forth in claim 3 wherein said control means comprises:

voltage generating means for generating at least one fixed bias voltage set outside said predetermined range; and switch means connected to receive said fixed bias voltage, said variable bias voltage and the output of said operating mode designating means and operable to cause said fixed bias voltage when said first mode signal is output and said variable bias voltage when said second mode signal is output to be supplied to said gate electrode of said convolver element.

5. The control apparatus as set forth in claim 4 wherein said voltage generating means includes a first generating means for generating a first fixed bias voltage higher than the upper limit of said predetermined range and a second generating means for generating a second fixed bias voltage lower than the lower limit of said predetermined range, and wherein said switch means is operable to cause said first fixed bias voltage when said variable bias voltage is in the proximity of said upper limit and said second fixed bias voltage when said variable bias voltage is in the proximity of said lower limit to be supplied to said gate electrode of said convolver element.

6. The control apparatus as set forth in claim 3 wherein said control means comprises:

voltage generating means for generating a fixed bias voltage higher than the upper limit of said predetermined range; and switch means connected to receive said fixed bias voltage, said variable bias voltage and the output of said operating mode designating means and operable to cause said fixed bias voltage when said first mode signal is output and said variable bias voltage when said second mode signal is output to be supplied to said gate electrode of said convolver element.

7. The control apparatus as set forth in claim 3 wherein said control means comprises:

voltage generating means for generating a fixed bias voltage lower than the lower limit of said predetermined range; and switch means connected to receive said fixed bias voltage, said variable bias voltage and the output of said operating mode designating means and operable to cause said fixed bias voltage when said first mode signal is output and said variable bias voltage when said second mode signal is output to be supplied to said gate electrode of said convolver element.

8. The control apparatus as set forth in claim 2 wherein said control means controls the resistivity of said piezoelectric layer of the convolver element when said first mode signal is output.

9. The control apparatus as set forth in claim 8 wherein said control means controls a temperature of said convolver element when said first mode signal is output.

10. The control apparatus as set forth in claim 9 wherein said control means comprises:

heater means for heating said convolver element; and switch means connected to receive the output of said operating mode designating means and operable to cause said heater means to be energized when said designating means outputs said first mode signal and to cause said heater means to be deenergized when said designating means outputs said second mode signal.

11. The control apparatus as set forth in claim 2 wherein said control means controls both a voltage applied to said gate electrode of said convolver element and the resistivity thereof.

12. The control apparatus as set forth in claim 11 wherein said control means comprises:

voltage generating means for generating at least one fixed bias voltage outside said predetermined range;

first switch means connected to receive said fixed bias voltage, said variable bias voltage and the output of said operating mode designating means and operable to provide said fixed bias voltage when said first mode signal is output and said variable bias voltage when said second mode signal is output to be supplied to said gate electrode of said convolver element;

heater means for heating said convolver element;

voltage source means connectable to said heater means; and second switch means connected to receive the output of said operating mode designating means and operable to connect said heater means to said voltage source means when said first mode signal is output and to disconnect said heater means from said voltage source means when said second mode signal is output.

13. The control apparatus as set forth in claim 12 wherein said voltage generating means includes a first generating means for generating a first fixed bias voltage higher than the upper limit of said predetermined range and a second generating means for generating a second fixed bias voltage lower than the lower limit of said predetermined range, and wherein said first switch means is operable to cause said first fixed bias voltage to be applied to said gate electrode when said bias voltage is in the proximity of the upper limit of said range and said second fixed bias voltage to be supplied to said gate electrode when said bias voltage is in the proximity of the lower limit of said range.

14. The control apparatus as set forth in claim 11 wherein said control means comprises:

voltage generating means for generating a fixed bias voltage higher than the upper limit of said predetermined range;

first switch means connected to receive said fixed bias voltage, said variable bias voltage and the output of said operating mode designating means and operable to provide said fixed bias voltage when said first mode signal is output and said variable bias voltage when said second mode signal is output to be supplied to said gate electrode of said convolver element;

heater means for heating said convolver element;

voltage source means connectable to said heater means; and second switch means connected to receive the output of said operating mode designating means and operable to connect said heater means to said voltage source means when said first mode signal is output and to disconnect said heater means from said voltage source means when said second mode signal is output.

15. The control apparatus as set forth in claim 3 wherein said control means comprises:

voltage generating means for generating a fixed bias voltage lower than the lower limit of said predetermined range;

first switch means connected to receive said fixed bias voltage, said variable bias voltage and the output of said operating mode designating means and operable to provide said fixed bias voltage when said first mode signal is output and said variable bias voltage when said second mode signal is output to be supplied to said gate electrode of said convolver element;

heater means for heating said convolver element;

voltage source means connectable to said heater means; and second switch means connected to receive said output of said operating mode designating means and operable to connect said heater means to said voltage source means when said first mode signal is output and to disconnect said heater means from said voltage source means when said second mode signal is output.

* * * * *